US010309028B2

(12) United States Patent
Yoshimura et al.

(10) Patent No.: US 10,309,028 B2
(45) Date of Patent: Jun. 4, 2019

(54) METHOD FOR PRODUCING SURFACE-TREATED STEEL SHEET, SURFACE-TREATED STEEL SHEET, AND ORGANIC RESIN COATED METAL CONTAINER

(71) Applicants: TOYO KOHAN CO., LTD., Tokyo (JP); NIPPON PAINT SURF CHEMICALS CO., LTD., Tokyo (JP); TOYO SEIKAN CO., LTD., Tokyo (JP)

(72) Inventors: Kunihiro Yoshimura, Yamaguchi (JP); Masanobu Matsubara, Yamaguchi (JP); Marie Sasaki, Yamaguchi (JP); Masahiko Matsukawa, Tokyo (JP); Keisuke Yoshida, Tokyo (JP); Wataru Kurokawa, Kanagawa (JP); Munemitsu Hirotsu, Kanagawa (JP); Mitsuhide Aihara, Kanagawa (JP)

(73) Assignees: TOYO KOHAN CO., LTD., Tokyo (JP); TOYO SEIKAN CO., LTD., Tokyo (JP)

( * ) Notice: Subject to any disclaimer, the term of this patent is extended or adjusted under 35 U.S.C. 154(b) by 344 days.

(21) Appl. No.: 15/032,956

(22) PCT Filed: Aug. 20, 2014

(86) PCT No.: PCT/JP2014/071728

§ 371 (c)(1),
(2) Date: Apr. 28, 2016

(87) PCT Pub. No.: WO2015/064186

PCT Pub. Date: May 7, 2015

(65) Prior Publication Data

US 2016/0265134 A1 Sep. 15, 2016

(30) Foreign Application Priority Data

Oct. 31, 2013 (JP) ..... 2013-226364

(51) Int. Cl.
*C25D 7/06* (2006.01)
*C25D 9/10* (2006.01)
(Continued)

(52) U.S. Cl.
CPC ..... *C25D 9/08* (2013.01); *C25D 9/10* (2013.01); *C25D 5/12* (2013.01); *C25D 5/48* (2013.01); *C25D 5/505* (2013.01); *C25D 7/0614* (2013.01)

(58) Field of Classification Search
CPC ..... B32B 15/01; C25D 7/06; C25D 9/10
(Continued)

(56) References Cited

U.S. PATENT DOCUMENTS

2004/0244874 A1 12/2004 Nakayama et al.
2005/0175798 A1 8/2005 Kurokawa et al.
(Continued)

FOREIGN PATENT DOCUMENTS

EP 2 290 129 A1 3/2011
EP 2 690 201 A1 1/2014
(Continued)

OTHER PUBLICATIONS

English machine translation of JP2006-348360, EPO, accessed Apr. 5, 2018.*
(Continued)

*Primary Examiner* — Humera N Sheikh
*Assistant Examiner* — Xiaobei Wang
(74) *Attorney, Agent, or Firm* — Muncy, Geissler, Olds & Lowe, P.C.

(57) ABSTRACT

Provided is a method for producing a surface-treated steel sheet including the step of forming a layer mainly composed of an oxygen compound containing Al onto a tin-plated steel sheet by conducting cathode electrolytic treatment to the tin-plated steel sheet using an electrolytic treatment solution containing Al ions and nitrate ions. For the electrolytic treatment solution, an electrolytic treatment solution not
(Continued)

containing F ions and where the amount of nitrate ions contained is 11,500 to 25,000 ppm by weight is used.

7 Claims, 2 Drawing Sheets

(51) Int. Cl.

| | |
|---|---|
| ***B32B 15/01*** | (2006.01) |
| ***C25D 9/08*** | (2006.01) |
| *C25D 5/12* | (2006.01) |
| *C25D 5/48* | (2006.01) |
| *C25D 5/50* | (2006.01) |

(58) Field of Classification Search
USPC ..... 205/316, 320, 333; 428/621, 623
See application file for complete search history.

(56) References Cited

U.S. PATENT DOCUMENTS

| | | | |
|---|---|---|---|
| 2006/0185769 | A1 | 8/2006 | Nakayama et al. |
| 2010/0230288 | A1 | 9/2010 | Kurokawa et al. |
| 2014/0377581 | A1 | 12/2014 | Uchikawa et al. |

FOREIGN PATENT DOCUMENTS

| | | | |
|---|---|---|---|
| JP | 56-081696 | | 7/1981 |
| JP | 2004-190121 | | 7/2004 |
| JP | 2005-097712 | | 4/2005 |
| JP | 2006-348360 | | 12/2006 |
| WO | WO 02/103080 | A1 | 12/2002 |
| WO | WO 2012/133111 | A1 | 10/2012 |

OTHER PUBLICATIONS

Chinese Office Action (w/English-language translation) dated Sep. 4, 2017 in corresponding CN Application No. 201480060000.9 (14 pages).

An Office Action from corresponding JP Application No. 2013-226364 dated Jun. 6, 2017 is attached with an English Translation; 8 pgs.

A Supplementary European Search Report from corresponding EP Application No. 14 85 9188 dated Jun. 2, 2017; 7 pgs.

Office Action dated Apr. 1, 2017 in CN Application No. 201480060000.9 (w/English-language translation) 15 pages.

* cited by examiner

METHOD FOR PRODUCING SURFACE-TREATED STEEL SHEET, SURFACE-TREATED STEEL SHEET, AND ORGANIC RESIN COATED METAL CONTAINER

BACKGROUND OF THE INVENTION

1. Technical Field of the Invention

The present invention relates to a method for producing a surface-treated steel sheet, a surface treated steel sheet, and an organic resin coated metal container.

2. Description of the Related Art

For steel sheets used in fields of home electronic appliances, building materials, vehicles, aircrafts, and containers, etc., chromate treatment is known as the treatment to improve adhesiveness to organic resin to be formed on the surface and for its excellent corrosion resistance and adhesiveness the treatment has been widely used.

For example, for tin-plated steel materials and tin-based alloy-plated steel materials used for metal containers such as cans for food and beverage, a chromate treatment where cathode electrolytic treatment is performed in an aqueous solution of dichromate sodium is used. Surfaces of the tin-plated steel materials and tin-based alloy-plated steel materials for which such chromate treatment is performed exhibit excellent adhesiveness to organic resin that an organic resin barrier layer can be successfully formed by coating or laminating, etc.

However, hexavalent chromium used in the chromate treatment is toxic and there is a problem that it imposes a large environmental burden. Further, in the chromate treatment, although the treatment can be performed in a way that does not leave hexavalent chromium in the final products to be produced and cause harm to users, in recent years, because there is a growing trend to reduce and eliminate use of any compounds containing chromium including hexavalent chromium, etc., and also because a large amount of expenses are required for wastewater treatment, exhaust gas treatment, waste disposal, etc., resulting from the chromate treatment, there is a demand to develop a non-chromium surface treatment to replace the chromate treatment.

As for the non-chromium surface treatment to replace the chromate treatment, there has been proposed, for example, treatment in which a steel sheet is immersed into a treatment liquid containing Zr (zirconium) or Ti (titanium) (Patent Document 1: International Publication No. WO 2002/103080). However, as to a surface-treated steel sheet obtained by immersion to such treatment liquid containing Zr or Ti, corrosion resistance is insufficient in a formed coating. Also, because its coating deposition speed is slow compared to an electrolytic chromic acid treated steel sheet (TFS) which has been conventionally used as a material for cans, there is a problem of significant deterioration in productivity. For these reasons, as a high-speed treatment process to take over the treatment by immersing the steel sheet into a treatment liquid, there has been proposed a cathode electrolytic treatment using an electrolytic treatment solution containing Zr or Ti, which is known for generating a metal-oxygen compound to the steel sheet surface at a high-speed (Patent Documents 2: Japanese Patent Application Publication No. 2004-190121 A and Patent Documents 3: Japanese Patent Application Publication No. 2005-97712 A).

More, as for the non-chromium surface treatment to replace the chromate treatment, there has been also proposed a surface-treated steel sheet where a coating of aluminum oxide with corrosion resistivity is formed to the surface of the steel sheet by cathode electrolytic treatment using an electrolytic treatment solution containing Al (aluminum) (Patent Document 4: Japanese Patent Application Publication No. 2006-348360 A).

SUMMARY OF THE INVENTION

However, with the techniques mentioned in the Patent Document 1 to Patent Document 4, when a surface-treated steel sheet is used for a can for food and beverage or the like and stored for a long period of time, there is a problem that its surface may become black. Specifically, when first forming a metal-oxygen compound layer of Al or the like onto the steel sheet by the cathode electrolytic treatment, a fluorine compound that acts as a complexing agent to enhance solubility of Zr ions is also added into the electrolytic treatment solution together with Al ions. Accordingly, to the layer formed on the steel sheet, Al, F, O and OH are included as main constituents. Further, in the layer composed of such components, a particle diameter of an Al oxygen compound tends to become coarse, thus there is a problem of sulfuration blackening generated by a reaction of tin and iron constituting the steel sheet with sulfur contained in food or drink.

On the other hand, the inventors, etc., have studied intensively to find out the cause that generates sulfuration blackening to a surface-treated steel sheet where an Al oxygen compound layer is formed on the steel sheet and have found out that sulfuration blackening that occurs to the surface-treated steel sheet is caused by an increase in the deposition speed of the Al oxygen compound and that the particle diameter of the depositing Al oxygen compound becomes coarse due to an influence of a fluorine compound added to the electrolytic treatment solution when forming the Al oxygen compound layer. Further, the inventors, etc., have found out that these problems can be solved by making the electrolytic treatment solution substantially not to contain F ions and also by controlling the amount of nitrate ions contained in the electrolytic treatment solution to a prescribed range. Furthermore, the present invention has been made based on these findings and provides a method for producing a surface-treated steel sheet which can suppress sulfuration blackening even when stored for a long period of time.

In other words, according to the present invention, by conducting the cathode electrolytic treatment using an electrolytic treatment solution containing Al ions and nitrate ions to a tin-plated steel sheet, in a method for producing a surface-treated steel sheet including the step of forming a layer whose main constituent is an oxygen compound containing Al on the tin-plated steel sheet, a method for producing a surface-treated steel sheet, wherein the electrolytic treatment solution does not contain F ion and where an amount of a nitrate ion contained is 11,500 to 25,000 ppm by weight, is provided.

In the production method of the present invention, when forming efficiency of the layer whose main constituent is an oxygen compound containing the Al is considered to be a value (mg/C) obtained by dividing the amount of Al in the layer by the amount of electricity in the cathode electrolytic treatment, preferably, the value is 0.011 or more.

In the production method of the present invention, electric conductivity of the electrolytic treatment solution is preferably 16 to 35 mS/cm.

In the production method of the present invention, the pH of the electrolytic treatment solution is preferably 2.0 to 4.0.

Further, according to the present invention, a surface-treated steel sheet obtained by the production method is provided.

Furthermore, according to the present invention, an organic resin coated metal container obtained using the surface-treated steel sheet is provided.

According to the present invention, when conducting cathode electrolytic treatment using an electrolytic treatment solution containing Al ions to a tin-plated steel sheet, by not including F ions to the electrolytic treatment solution and by controlling the amount of nitrate ions contained in the electrolytic treatment solution to a prescribed range, a dense Al oxygen compound layer having a small particle diameter can be formed on the tin-plated steel sheet. Consequently, a method for producing a surface-treated steel sheet that can suppress sulfuration blackening when stored for a long period of time can be provided.

DESCRIPTION OF THE PREFERRED EMBODIMENT

Figure 1A:
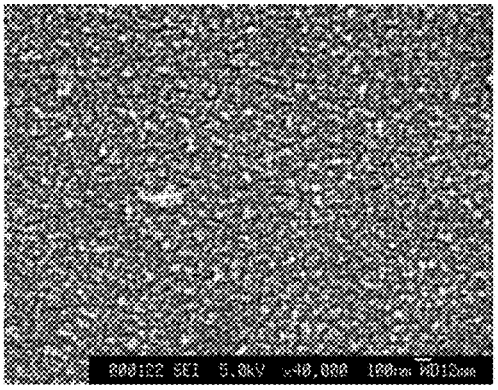
FIGS. 1A and 1B are a SEM picture of the surface of the surface-treated steel sheet obtained in an example and comparative example.

In the method for producing a surface-treated steel sheet of the present invention, when forming a layer in which the main constituent is an oxygen compound containing Al by conducting cathode electrolytic treatment to a tin-plated steel sheet using an electrolytic treatment solution containing Al ions and nitrate ions, an electrolytic treatment solution not containing F ions and where the amount of nitrate ions contained is 11,500 to 25,000 ppm by weight is used as the electrolytic treatment solution.

In the following, the method of producing a surface-treated steel sheet according to the present invention is described.

First, in the present invention, a tin-plated steel sheet is prepared as a base material of a surface-treated steel sheet. The tin-plated steel sheet as the base material of the surface-treated steel sheet can be obtained by applying tin-plating to a steel sheet and thereby forming a tin-plated layer on the steel sheet.

The steel sheet for applying tin-plating is not particularly limited. For example, a hot-rolled steel sheet that uses an aluminum-killed steel continuously cast material or the like as the base and a cold-rolled steel sheet prepared by cold-rolling the hot-rolled steel sheet can be used. Or, as for the steel sheet to apply tin-plating, a steel sheet in which corrosion resistivity is improved by forming a nickel-plated layer on the steel sheet, heating the steel sheet for thermal diffusion, and forming a Ni—Fe alloy layer between the steel sheet and the nickel-plated layer can be used.

The method of applying tin-plating to the steel sheet is not particularly limited, and methods using a known plating bath such as a ferrostan bath, a halogen bath, a sulfuric acid bath or the like can be used. More, as for the tin-plated steel sheet obtained by applying tin-plating, a Sn—Fe alloy layer may be formed between the steel sheet and the tin-plating layer by conducting treatment of immediate cooling (reflow treatment) after heating the tin-plated steel sheet to the melting temperature of tin or over.

The thickness of the tin-plating layer formed on the steel sheet is not particularly limited. A suitable thickness can be selected depending on the intended usage of the surface-treated steel sheet to be produced, or preferably 0.1 to 15 $g/m^2$.

The thickness of the tin-plated steel sheet is not particularly limited. A suitable thickness can be selected depending on the intended usage of the surface-treated steel sheet to be produced, or preferably 0.07 to 0.4 mm.

Next, in the present invention, an Al oxygen compound layer is formed on a tin-plated steel sheet by conducting cathode electrolytic treatment to a prepared tin-plated steel sheet using an electrolytic treatment solution containing Al ions and nitrate ions.

Pretreatment may be performed before forming an oxygen compound of Al on the tin-plated steel sheet to remove a tin oxide film layer on the surface. The pretreatment may be performed using a carbonate alkali aqueous solution of sodium carbonate, sodium bicarbonate, etc., by conducting the cathode electrolytic treatment, anode electrolytic treatment, or both to the tin-plated steel sheet under conditions of 0.5 to 20 $A/dm^2$ for 0.1 second to 1.0 second.

In the present invention, as for the electrolytic treatment solution containing Al ions and nitrate ions, an electrolytic treatment solution not containing F ions and where the amount of nitrate ions contained is 11,500 to 25,000 ppm by weight is used.

Also, in the present invention, the electrolytic treatment solution should be the one that does not substantially contain F ions that F ions may be contained for the amount equivalent to that of impurities. This is because as many F atoms exist in the natural world and few F atoms are included even in industrial water that when such F atoms are contained in the electrolytic treatment solution, consequently F ions are included in the electrolytic treatment solution. In such a case, the electrolytic treatment solution may contain F ions for about an extremely small amount (the amount equivalent to that of impurities) that is, for example, when the total amount of F forming complex ions with metal and free F contained in the electrolytic treatment solution is considered as the amount of F ions, the amount of F ions is preferably 50 ppm by weight or less, more preferably 20 ppm or less, and further preferably 5 ppm or less.

More, in the present invention, in the electrolytic treatment solution, the amount of nitrate ions contained is 11,500 to 25,000 ppm by weight, preferably 12,500 to 20,000 ppm by weight, and more preferably 15,000 to 20,000 ppm by weight.

According to the present invention, when forming an Al oxygen compound layer on a tin-plated steel sheet by cathode electrolytic treatment using an electrolytic treatment solution containing Al ions, by using an electrolytic treatment solution not containing F ions and where the amount of nitrate ions contained is within the above range as the electrolytic treatment solution, a surface-treated steel sheet that can suppress sulfuration blackening even when stored for a long period of time can be obtained.

Further, when forming an Al oxygen compound layer on a tin-plated steel sheet by cathode electrolytic treatment using the electrolytic treatment solution containing Al ions, when F ions are contained in the electrolytic treatment solution, electric conductivity of the electrolytic treatment solution improves and when electric current is fed, electrolysis of water can be successfully generated near the surface of the tin-plated steel sheet. Accordingly, the pH near the surface of the tin-plated steel sheet can be raised and an Al oxygen compound can be efficiently deposited. Here, the F ions in the electrolytic treatment solution are mainly derived from a fluorine compound added as a complexing agent to improve solubility of Al ions.

However, when F ions are included in the electrolytic treatment solution as above, deposition speed of the Al oxygen compound layer is increased excessively and thus a particle diameter of the deposited Al oxygen compound becomes as coarse as approximately 100 nm, and it is considered that possibility that tin and iron consisting the steel sheet to become exposed is high. In such a case, when the obtained surface-treated steel sheet is used for cans for food and beverage or the like, there is a problem that tin and iron in the exposed part of the tin-plated steel sheet react with sulfur contained in the food and beverage thus causing sulfuration blackening. Meanwhile, when a fluorine compound is not added and F ions are not included in such electrolytic treatment solution, electric conductivity of the electrolytic treatment solution lowers excessively and deposition speed of the Al oxygen compound decreases. Consequently, productivity of the surface-treated steel sheet tends to become lower compared to the chromate treatment which is conventionally used.

On the other hand, in the present invention, by using an electrolytic treatment solution not containing the F ions and where the amount of nitrate ions contained is within the above range as an electrolytic treatment solution for forming an Al oxygen compound layer, even when F ions are not contained in the electrolytic treatment solution, electric conductivity of the electrolytic treatment solution can be controlled within the appropriate range by the effect of nitrate ions. Accordingly, according to the present invention, because the electric conductivity of the electrolytic treatment solution is within the appropriate range, not only the deposition speed of the Al oxygen compound can be increased but also a particle of the depositing Al oxygen can be made as fine as a particle diameter of 50 nm or less, thus a dense Al oxygen compound layer can be formed on the tin-plated steel sheet and exposure of the tin-plated steel sheet can be prevented. As a result, sulfuration blackening of the obtained surface-treated steel sheet can be prevented.

Additionally, in the present invention, as for the method to measure the amount of F ions and nitrate ions contained in the electrolytic treatment solution, for example, a method of measurement by quantitative analysis using an ion chromatography can be used.

Further, as for a compound to control the contained amount of nitrate ions constituting the electrolytic treatment solution, though not limited to, such as ammonium nitrate, nitric acid, etc., can be used. In the present invention, the above compounds can be used singly or in a combination of two or more. Still, as described in the following, when aluminum nitrate is used as a metal compound to form Al ions constituting the electrolytic treatment solution, by adding the above compound while taking into account the amount the amount of nitrate ions that derive from the aluminum nitrate, the amount of nitrate ions contained can be controlled.

A metal compound to form Al ions constituting the electrolytic treatment solution is not particularly limited. For example, aluminum nitrate, aluminum sulfate, aluminum chloride, aluminum hydroxide, aluminum carbonate, etc., can be used. In the present invention, the above metal compounds can be used singly or in a combination of two or more.

More, the amount of Al ions contained in the electrolytic treatment solution for forming an Al oxygen compound layer can be selected accordingly depending on the layer amount of the Al oxygen compound layer to be formed, but preferably 0.5 to 10 g/lit. and more preferably 1 to 5 g/lit. in a mass concentration of Al atoms. By controlling the amount of Al ions contained in the electrolytic treatment solution within the above range, stability of the electrolytic treatment solution and deposition efficiency of the Al oxygen compound can be improved.

In the present invention, the Al oxygen compound to be deposited by the cathode electrolytic treatment can be a complex oxide slightly containing a metal element other than Al. In other words, when depositing the Al oxygen compound to a tin-plated steel sheet using the electrolytic treatment solution, because a slight amount of metal ions such as iron, tin, nickel, etc., eluted from the tin-plated steel sheet is contained in the electrolytic treatment solution, consequently, an Al oxygen compound to be deposited inevitably contains these metals, thus the Al oxygen compound can be a complex oxide of aluminum with another metal.

Further, to the electrolytic treatment solution for forming an Al oxygen compound layer, at least one or more types of additives selected from such as an organic acid including citric acid, lactate, tartaric acid, glycolic acid, etc., polyacrylic acid, polyitaconic acid, phenol resin and the like may be added. In the present invention, by adding an additive such as an organic acid and phenol resin, etc., to the electrolytic treatment solution, an organic acid can be included to the Al oxygen compound layer to be formed. As a result, adhesiveness of an organic resin layer formed on the Al oxygen compound layer can be improved.

The pH of the electrolytic treatment solution for forming an Al oxygen compound layer is preferably 2.0 to 4.0 and more preferably 2.5 to 3.5. By making the pH of the electrolytic treatment solution within the range with a pH adjustor, stability of the electrolytic treatment solution and efficiency of Al oxygen compound deposition can be improved.

Forming efficiency of an Al oxygen compound layer formed as described above can be represented with a value [(mg/C)] determined by dividing the Al amount ($mg/m^2$) in the layer formed on the tin-plated steel sheet by the amount of electricity ($C/m^2$) in the cathode electrolytic treatment. The obtained value is preferably 0.011 or more and more preferably 0.013 or more. When the forming efficiency is too low, productivity of the surface-treated steel sheet tends to be reduced compared to the conventionally used chromate treatment that it is important to make the forming efficiency within the above range. Also, depending on the composition of the electrolytic treatment solution, low forming efficiency indicates an excessive etching of the tin-plating on the surface of the tin-plated steel sheet. In such a case, by containing a large amount of tin or iron in the Al oxygen compound layer, sulfuration blackening may occur more easily when food and beverage are stored.

The electric conductivity of the electrolytic treatment solution for forming an Al oxygen compound layer is preferably 16 to 35 mS/cm and more preferably 20 to 30 mS/cm. When the electric conductivity of the electrolytic treatment solution is too low, forming efficiency of the Al oxygen compound layer is reduced and productivity of the surface-treated steel sheet tends to be reduced compared to the conventionally used chromate treatment. On the other hand, when the electric conductivity of the electrolytic treatment solution is too high, the tin-plating layer on the surface of the tin-plated steel sheet is etched when the cathode electrolytic treatment is conducted, and forming efficiency of the Al oxygen compound layer is reduced. Also, by increasing the etching of the tin-plating layer, more dissolved tin is included to the Al oxygen compound layer thus sulfuration blackening may occur easily when food and beverage are stored.

As for the method to make the electric conductivity of the electrolytic treatment solution within the above range, for example, a method of controlling the amount of nitrate ions contained in the electrolytic treatment solution to within the range can be used.

An electric current density for forming an Al oxygen compound layer to the tin-plated steel sheet by the cathode electrolytic treatment is, though not particularly limited to, preferably 1 to 30 $A/dm^2$ and more preferably 1 to 10 $A/dm^2$. More, when calculating the forming efficiency of the Al oxygen compound layer, $A/dm^2$ is converted to $A/m^2$ and then calculation is performed.

When forming an Al oxygen compound layer to a tin-plated steel sheet by the cathode electrolytic treatment, it is preferable to use an intermittent electrolysis method where a cycle of "energization and stop of energization" is repeated. When using the method, the total energization time for the base material (the total energization time when the cycle of "energization and stop of energization" is repeated for several times) is preferably 1.5 seconds or less and more preferably 1 second or less.

Furthermore, when forming an Al oxygen compound layer to a tin-plated steel sheet by the cathode electrolytic treatment, any sheet that does not dissolve into the electrolytic treatment solution during the cathode electrolytic treatment can be used as a counter electrode sheet set to the base material. However, from the viewpoint of not dissolving easily to the electrolytic treatment solution due to small oxygen overvoltage, a titanium sheet coated with iridium oxide or a titanium sheet coated with platinum is preferable.

Additionally, in the present invention, before forming an Al oxygen compound layer to a tin-plated steel sheet by the cathode electrolytic treatment, pretreatment to reduce the tin oxide film layer formed on the surface of the tin-plated steel sheet may be performed to the tin-plated steel sheet. That is, because there is a tin oxide film layer oxidized by oxygen in the air formed to the surface of the tin-plated steel sheet, and because this tin oxide film layer disturbs formation of an Al oxygen compound layer, pretreatment may be conducted in advance to the tin-plated steel sheet to reduce such tin oxide film layer. As for the pretreatment, a method of conducting cathode electrolytic treatment by using the tin-plated steel sheet as the cathode while immersing the tin-plated steel sheet into an alkali aqueous solution can be used. By doing this, the tin oxide film layer formed to the surface of the tin-plated steel sheet can be made thin and an Al oxygen compound layer can be successfully formed onto the tin-plated steel sheet.

The thickness of an Al oxygen compound layer to be formed on a tin-plated steel sheet is, based on the Al amount in an Al oxygen compound, preferably 2 to 20 $mg/m^2$ and more preferably 2 to 15 $mg/m^2$. When the amount of Al in the Al oxygen compound is too small, deposition of the Al oxygen compound onto the tin-plated steel sheet becomes uneven, and a part of the tin-plated steel sheet becomes exposed, leading sulfuration blackening to occur easily when the obtained surface-treated steel sheet is stored for a long period of time. On the other hand, when the amount of Al in the Al oxygen compound is too large, adhesiveness of an organic resin layer tends to be reduced when forming an organic resin layer onto the Al oxygen compound layer.

As mentioned above, according to the production method of the present invention, a surface-treated steel sheet can be obtained.

The surface-treated steel sheet obtained according to the production method of the present invention can be used as the material for can containers and can lids, etc. When using the surface-treated steel sheet as the material for can containers and can lids, etc., an organic-resin-coated surface-treated steel sheet where an organic resin layer is formed on the surface of the surface-treated steel sheet is used in general. An organic resin constituting the organic resin layer is not particularly limited. Any organic resin can be selected according to the usage of the surface-treated steel sheet (for example, for use as a can container or the like to be filled with a specific content). For example, a thermoplastic resin or thermosetting coating or the like can be used.

As for a thermoplastic resin, an olefin resin film such as polyethylene, polypropylene, ethylene-propylene rubber, ethylene-vinyl acetate copolymer, ethylene-acrylic acid ester copolymer, and ionomer, etc., or a polyester film such as polyethylene terephthalate and polybutylene terephthalate, etc., or an unstretched or biaxially stretched thermoplastic resin such as a polyvinylchloride film and polyvinylidene chloride film, etc., or a polyamide film such as nylon 6, nylon 66, nylon 11, and nylon 12, etc., may be used. Particularly preferable among these are non-oriented polyethylene terephthalate obtained by copolymerization of isophthalic acid. Also, a resin for constituting such organic resin layer can be used singly or blended with a different resin.

When coating with a thermoplastic resin as an organic resin layer, a resin layer can be a single layer or a multi-layered resin layer formed such as by co-extrusion or the like. It is advantageous to use a multi-layered polyester resin layer in that a polyester resin with a composition excellent in adhesiveness can be selected for the base layer, that is a surface-treated steel sheet side, and a polyester resin with a composition excellent in content resistance, that is extraction resistance and non-adsorbability of flavor components, can be selected for the top layer.

Examples of the multi-layered polyester resin layer are, when indicated as top layer/bottom layer, polyethylene terephthalate/polyethylene terephthalate-isophthalate, polyethylene terephthalate/polyethylene cyclohexylenedimethylene-terephtharate, polyethylene terephthalate containing a small amount of isophthalate-isophthalate/polyethylene terephthalate containing a large amount of isophthalate-isophthalate, polyethylene terephthalate-isophthalate/[mixture of polyethylene terephthalate-isophthalate and polybutylene terephthalate-adipate], etc., but of course, not limited to these examples. A thickness ratio of top layer:bottom layer is preferably within the range of 5:95 to 95:5.

For an organic resin layer, known compounding agents for a resin, for example, anti-blocking agent such as amorphous silica or the like, inorganic filler, various types of antistatic agents, lubricant, antioxidant, ultraviolet absorber, etc., can be mixed according to a known formula.

Of those above, tocopherol (vitamin E) is preferable. Tocopherol is known as an antioxidant for improving dent resistance by preventing decrease in the molar amount due to oxidative decomposition during heat treatment of a polyester resin. Specifically, when tocopherol is mixed to a polyester composition prepared by mixing the ethylene polymer to the polyester resin as a modified resin component, even when a crack is generated in the layer due to exposure to harsh conditions such as retorting sterilization or hot vendor, etc., not only resistance to dent is obtained, but also the progress of corrosion from the crack can be prevented and an effect of improvement in corrosion resistance can be obtained.

Tocopherol is preferably mixed in an amount of 0.05 to 3% by weight, and more particularly 0.1 to 2% by weight.

The thickness of the organic resin coating applied to a surface-treated steel sheet obtained according to the present invention is within the range of 3 to 50 μm in general and particularly, to be within the range of 5 to 40 μm is preferable for a thermoplastic resin coating. In the case of a coating film, the thickness after baking is preferably within the range of 1 to 50 μm and particularly, to be within the range of 3 to 30 μm is preferable. When the thickness is less than the above range, corrosion resistance becomes insufficient and when the thickness is more than the above range, a problem may arise in the point of processability.

Generation of an organic resin layer on a surface-treated steel sheet obtained according to the present invention can be performed by any means. For example, in the case of a thermoplastic resin coating, an extrusion coating method, a cast layer thermal adhesion method, and a biaxially-stretched layer thermal adhesion method or the like, can be used. When the extrusion coating method is used, an organic resin layer can be generated by coating the surface-treated steel sheet with a polyester resin in a molten state by extrusion and thermal bonding. In other words, after melt-kneading the polyester resin with an extruder, the polyester resin is extruded from a T-die in the form of a thin film, the extruded molten resin film is delivered through a pair of laminating rolls together with the surface-treated steel sheet to be pressed and combined together with cooling, and then immediately cooled. When coating with a multi-layered polyester resin layer by extrusion, an extruder for the top resin layer and an extruder for the bottom resin layer are used. Resin flows from each extruder are merged in a multi-layer-extrusion-die and then extrusion coating is performed as in the case of a single-layer resin. Also, by delivering a surface-treated steel sheet between a pair of laminating rolls and by supplying a molten-resin web to both sides, a polyester resin coating layer can be formed on both surfaces of the substrate.

When forming an organic resin layer composed of a polyester resin with the extrusion coating method, specifically, the following methods can be used. A surface-treated steel sheet is heated in advance as needed with a heater and supplied to the nip position located between a pair of laminating rolls. Meanwhile, the polyester resin is extruded to a thin film through a die head of the extruder, supplied between the laminating roll and the surface-treated steel sheet and bonded with compression to the surface-treated steel sheet with the laminating rolls. The laminating rolls are kept at a constant temperature, and used to thermally bond the thin film composed of a thermoplastic resin such as polyester to the surface-treated steel sheet by bonding with compression and also cool the surface-treated steel sheet from both sides to form an organic resin layer composed of the polyester resin onto the surface-treated steel sheet to obtain an organic-resin coated surface-treated steel sheet. In general, the organic-resin coated surface-treated steel sheet is further subjected to an immediate cooling by leading to a cooling water bath or the like to avoid heat crystallization in the formed organic resin layer.

In this extrusion coating method, crystallinity of the polyester resin layer is suppressed to a low level, that is a difference of 0.05 g/cm$^3$ or less from the non-crystalline density, that satisfactory processability is assured for the subsequent can-making processing and lid processing, etc. Of course, the immediate cooling operation is not limited to the above examples, and the laminated sheet can also be immediately cooled by spraying cooling water to the created organic-resin-coated surface-treated steel sheet.

Thermal bonding of the polyester resin to the surface-treated steel sheet is conducted using the quantity of heat held by a molten-resin layer and the quantity of heat held by a surface-treated steel sheet. The heating temperature ($T_1$) for the surface-treated steel sheet is 90° C. to 290° C. in general, and in particular, a temperature of 100° C. to 280° C. is suitable, whereas for the laminating rolls, a temperature within the range of 10° C. to 150° C. is suitable.

Further, the organic resin layer to be formed on the surface-treated steel sheet can be formed by thermally bonding a polyester resin film made in advance with the T-die method or inflation film-formation method to the surface-treated steel sheet. As for the film, an unstretched film prepared with the cast molding method in which the extruded film is immediately cooled can also be used. Also, a biaxially-stretched film obtained by biaxially stretching this film at a stretching temperature, either subsequently or simultaneously, and thermally fixing the film after stretching can also be used.

The surface-treated steel sheet obtained by the production method of the present invention can be molded into can containers, after having formed with an organic resin layer to the surface to obtain an organic-resin-coated surface-treated steel sheet, and by processing the organic-resin-coated surface-treated steel sheet. Although not limited to, the can container can be a three-piece can (welded can) with a joint on its side or a seamless can (two-piece can).

The seamless cans may be produced such that the organic resin layer is located inside the can, by any conventionally known means, such as drawing process, drawing/redrawing process, stretching process via drawing/redrawing, stretching/ironing process via drawing/redrawing, or drawing/ironing process. Also, for the seamless cans produced through the above processes, which are produced using a highly sophisticated process, such as stretching process via drawing/redrawing and stretching/ironing process via drawing/redrawing, it is particularly preferable that the organic resin layer is the thermoplastic resin coating by the extrusion coating method.

In other words, such an organic-resin-coated surface-treated steel sheet is excellent in adhesiveness at processing, that a seamless can excellent in coating adhesiveness even when subjected to harsh processes and excellent in corrosion resistance can be provided.

From the surface-treated steel sheet obtained by the production method of the present invention, after forming an organic resin layer to the surface of the surface-treated steel sheet to obtain an organic-resin-coated surface-treated steel sheet, can lids can be also produced by processing the organic-resin-coated surface-treated steel sheet. Although not limited to, the can lid can be a flat lid, an easy-open can lid of a stay-on-tab type, or an easy-open can lid of a full-open type, etc.

EXAMPLES

Hereinafter, the present invention will be specifically described with reference to examples, but the present invention is not limited to these examples.

Further, the evaluation method of each characteristic were as follows.

<Analysis of the Electrolytic Treatment Solution>

For the electrolytic treatment solution, Al ion concentration was measured using an ICP emission spectroscopy (available from Shimazu Corporation, ICPE-9000) and F ion concentration and nitrate ion concentration were measured using an ion chromatograph (available from Dionex, DX-500). Also, for the electrolytic treatment solution, the pH was measured using a pH meter (available from HORIBA, Ltd.). Further, for the electrolytic treatment solution, electric conductivity was measured using an electric conductivity meter (available from Nikko Hansen & Co., Ltd., CyberScan CON110). Additionally, analysis of the electrolytic treatment solution was performed in all examples and comparative examples described in the following.

<Observation of the Surface-Treated Steel Sheet Surface>

For the surface-treated steel sheet obtained by forming an Al oxygen compound layer to a tin-plated steel sheet, after having conducted carbon vapor deposition to the surface, the surface was observed under conditions of accelerating voltage of 5 kV and an electric current of 12 μA using a scanning electron microscope (available from JOEL Ltd., JSM-6330F). More, the observation of the surface-treated steel sheet surface was only performed in Example 1 and Comparative Example 1 among examples and comparative examples described in the following.

<Measurement of the Amount of Al in the Al Oxygen Compound Layer>

For the surface-treated steel sheet obtained by forming an Al oxygen compound layer to a tin-plated steel sheet, the amount of Al contained in the Al oxygen compound layer was measured using an X-ray fluorescence spectrometer (available from Rigaku Corporation, ZSX100e). Additionally, the measurement of the amount of Al in the Al oxygen compound layer was performed in all examples and comparative examples described in the following.

<Forming Efficiency of the Al Oxygen Compound Layer>

When the Al amount per the amount of electricity used during formation of an Al oxygen compound layer on a tin-plated steel sheet by cathode electrolytic treatment, that is, a product value of electric current density and energization time, which are the conditions of the cathode electrolytic treatment was considered as the amount of electricity, a value obtained by dividing the amount of Al in the Al oxygen compound layer formed by the cathode electrolytic treatment by the amount of electricity ["Al amount ($mg/m^2$)"/"amount of electricity ($C/m^2$)"], that is "Al amount"/"amount of electricity (mg/C)" was determined and the value was evaluated based on the following standard (In Table 1 and Table 2, although the values of the amount of electricity are shown in $C/dm^2$, calculations were performed after converting them to $C/m^2$ to unify the units.). Further, evaluation of the forming efficiency of the Al oxygen compound layer was performed in all examples and comparative examples described in the following.

A: The Al amount per amount of electricity (Al amount/amount of electricity) was 0.011 or more.

B: The Al amount per amount of electricity (Al amount/amount of electricity) was less than 0.011.

<Evaluation of Resistance to Sulfuration Blackening (Actual Content)>

To the surface-treated steel sheet obtained by forming an Al oxygen compound layer on a tin-plated steel sheet, by bake coating an epoxy phenol coating material onto the Al oxygen compound layer, an organic-resin-coated surface-treated steel sheet was obtained. Then, the obtained organic-resin-coated surface-treated steel sheet was cut into a 40 mm square and its cut surfaces were protected with a 3 mm-width tape to prepare a test piece. Then, the prepared test piece was put into an empty can (available from Toyo Seikan Co., Ltd., J280TULC), and after filling the can with salmon boiled in water to immerse entire test piece, the can was seamed with an aluminum lid and subjected to retort treatment under conditions of 117° C. for 60 minutes. Following this, the can was stored under an environment of 55° C. for one month and then opened and a degree of blackening in the test piece was observed by sight and evaluated based on the following standard. The evaluation of resistance to sulfuration blackening (actual content) was performed only in Example 2 to Example 5, Comparative Example 2 to Comparative Example 4, and Reference Example 1 among those examples and comparative examples described in the following.

3 points: When judged by sight, a degree of blackening was obviously low compared to Reference Example 1.

2 points: When judged by sight, a degree of blackening was equivalent to that in Reference Example 1 when compared.

1 point: When judged by sight, a degree of blackening was obviously higher compared to Reference Example 1.

Additionally, in the evaluation of resistance to sulfuration blackening (actual content), when the evaluation based on the above standard was 3 points, the surface-treated steel sheet was judged to have sufficient resistance to sulfuration blackening when applied for use as a can for food and beverage.

<Evaluation of Resistance to Sulfuration Blackening (Model Liquid)>

To the surface-treated steel sheet obtained by forming an Al oxygen compound layer on a tin-plated steel sheet, by bake coating an epoxy phenol coating material onto the Al oxygen compound layer, an organic-resin-coated surface-treated steel sheet was obtained. Then, the obtained organic-resin-coated surface-treated steel sheet was cut into a 40 mm square and its cut surfaces were protected with a 3 mm-width tape to prepare a test piece. Then, the prepared test piece was put into an empty can (available from Toyo Seikan Co., Ltd., J280TULC), and after filling the can with the following model liquid to immerse entire test piece, the can was seamed with an aluminum lid and subjected to retort treatment under conditions of 130° C. for 5 hours. Following this, the can was opened and a degree of blackening in the test piece was observed by sight and evaluated based on the following standard. The evaluation of resistance to sulfuration blackening (model liquid) was performed in all examples and comparative examples described in the following.

Model liquid: An aqueous solution of pH 7.0 containing sodium dihydrogen phosphate ($NaH_2PO_4$) at a concentration of 3.0 g/lit., dibasic sodium phosphate ($Na_2HPO_4$) at a concentration of 7.1 g/lit., and L-cysteine hydrochloride monohydrate at a concentration of 6 g/lit.

3 points: When judged by sight, a degree of blackening was obviously low compared to Reference Example 1.

2 points: When judged by sight, a degree of blackening was equivalent to that in Reference Example 1 when compared.

1 point: When judged by sight, a degree of blackening was obviously higher compared to Reference Example 1.

Also, as for the evaluation of resistance to sulfuration blackening (model liquid), when the evaluation based on the above standard was 3 points, the surface-treated steel sheet was judged to have sufficient resistance to sulfuration blackening when applied for use as a can for food and beverage.

<Evaluation of Corrosion Resistivity (Model Liquid)>

To the surface-treated steel sheet obtained by forming an Al oxygen compound layer on a tin-plated steel sheet, by bake coating an epoxy phenol coating material onto the Al oxygen compound layer, an organic-resin-coated surface-treated steel sheet was obtained. Then, the obtained organic-resin-coated surface-treated steel sheet was cut into a 40 mm square and its cut surfaces were protected with a 3 mm-width tape to prepare a test piece. Then, a cross-cut scratch that reaches up to the steel sheet was made to the prepared test piece with a cutter and the test piece was subjected to bulging for 3 mm with an Erichsen tester (available from Coating Tester Co., Ltd.) while placing the intersection part of the cross cut to the peak of the bulging part. Following this, the bulged test piece was placed in a sealing container, and stored for 24 hours under an environment of 90° C. after having the container filled with the following model liquid. Then, the sealing container was opened and a degree of corrosion in the test piece was observed by sight and evaluated based on the following standard. The evaluation of resistance to sulfuration blackening (model liquid) was performed in all examples and comparative examples described in the following.

Model liquid: An aqueous solution where both NaCl and citric acid were dissolved by 1.5% by weight.

3 points: When judged by sight, a degree of corrosion was obviously low compared to Reference Example 1.

2 points: When judged by sight, a degree of corrosion was equivalent to that in Reference Example 1 when compared.

1 point: When judged by sight, a degree of corrosion was obviously higher compared to Reference Example 1.

Also, as for the evaluation of corrosion resistivity (model liquid), when the evaluation based on the above standard was 2 points or over, the surface-treated steel sheet was judged to have sufficient corrosion resistivity when applied for use as a can for food and beverage.

Example 1

For a base sheet, a low carbon cold-rolled steel sheet (sheet thickness of 0.225 mm) having the following chemical composition was prepared.

Next, using an aqueous solution of an alkali degreasing agent (available from Nippon Quaker Chemical, Ltd., Formula 618-TK2) degreasing was conducted to the prepared steel sheet by the cathode electrolytic treatment under conditions of 60° C. for 10 seconds. Then, the degreased steel sheet was washed with tap-water and then immersed to a pickling treatment agent (a 5%-by-volume aqueous solution of sulfuric acid) for 5 seconds at room temperature for pickling. Following this, the steel sheet was washed with tap-water and tin-plating was conducted to the steel sheet using a known Ferrostan bath under the following conditions to form a tin-plating layer where the Sn amount is 2.8 g/m$^2$ to the surface of the steel sheet. Further, the steel sheet formed with the tin-plating layer was washed with water, allowed to generate heat by flowing direct electric current, heated up to the melting point of tin or more, and subjected to reflow treatment by applying tap-water for immediate cooling to produce a tin-plated steel sheet.

Bath temperature: 40° C.

Electric current density: 10 A/dm$^2$

Anode material: 99.999% metal tin available on the market

Total energization time: 5 seconds (by 5 cycles when 1 cycle is considered as 1-second energization and 0.5-second stop)

Then, to the obtained tin-plated steel sheet, the cathode electrolytic treatment was conducted under the following conditions while immersing the tin-plated steel sheet to an electrolytic treatment solution and stirring the electrolytic treatment solution, using an iridium oxide coated titanium sheet disposed to a position where an inter-electrode distance becomes 17 mm as an anode. Then, the tin-plated steel sheet was washed with running water and dried to obtain a surface-treated steel sheet having formed with an Al oxygen compound layer on the tin-plated steel sheet.

Electrolytic treatment solution: An aqueous solution where aluminum nitrate was dissolved as an Al compound to make the Al ion concentration to 1,500 ppm by weight, nitrate ion concentration to 15,000 ppm by weight and F ion concentration to 0 ppm by weight.

pH of electrolytic treatment solution: 3.0

Temperature of electrolytic treatment solution: 40° C.

Electric current density: 4 A/dm$^2$

Total energization time: 0.1 seconds (1 cycle by 0.1-second energization)

Figure 1B:
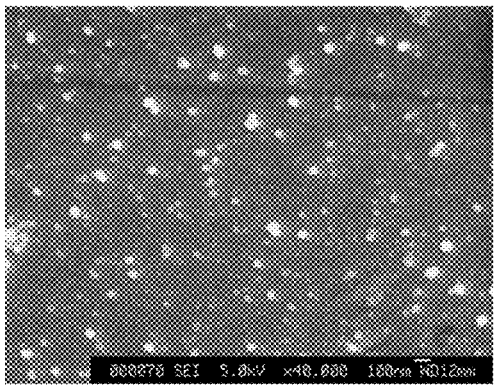

Then, to the obtained surface-treated steel sheet, in the methods described above, evaluations for the observation of the surface-treated steel sheet surface, measurement of the amount of Al in the Al oxygen compound layer, and forming efficiency of the Al oxygen compound layer were performed. The results are shown in Table 1 and FIG. 1. As for FIG. 1, FIG. 1(A) shows a SEM picture of the surface of the surface-treated steel sheet in Example 1 and FIG. 1(B) shows a SEM picture of the surface of the surface-treated steel sheet in Comparative Example 1 described in the following.

Further, by coating an epoxy phenol type coating material to the obtained surface-treated steel sheet so as to make the coating film thickness 70 mg/dm$^2$ after baking and drying, and by baking at 200° C. for 10 minutes, an organic-resin-coated steel sheet was obtained. Then, to the obtained organic-resin-coated steel sheet, evaluation of resistance to sulfuration blackening (model liquid) and evaluation of corrosion resistivity (model liquid) were performed in the methods described above. The results are shown in Table 1.

Example 2

A surface-treated steel sheet and an organic-resin-coated steel sheet were prepared in the same manner as in Example 1 except that the thickness of the tin-plating layer formed on the steel sheet was changed to 5.6 g/m$^2$ by the Sn amount by changing tin-plating conditions. Then, in the methods described above, evaluations for measurement of the amount of Al in the Al oxygen compound layer and forming efficiency of the Al oxygen compound layer, evaluation of resistance to sulfuration blackening (actual content), evaluation of resistance to sulfuration blackening (model liquid), and evaluation of corrosion resistivity (model liquid) were performed. The results are shown in Table 1.

Example 3 and Example 4

A surface-treated steel sheet and an organic-resin-coated steel sheet were prepared and evaluated in the same manner as in Example 2 except that the number of cycles was increased and the total energization time was changed as shown in Table 1 in the cathode electrolytic treatment to form an Al oxygen compound layer on a tin-plated steel sheet. The results are shown in Table 1.

Example 5

A surface-treated steel sheet and an organic-resin-coated steel sheet were prepared and evaluated in the same manner as in Example 3 except that the cathode electrolytic treatment was performed in an alkali aqueous solution under the following conditions as a pretreatment to form an Al oxygen compound layer on a tin-plated steel sheet by the cathode electrolytic treatment using the tin-plated steel sheet as a cathode. The results are shown in Table 1.

Alkali aqueous solution: sodium carbonate aqueous solution (10 g/lit.)

Temperature: 40° C.

Electric current density: 3 A/dm$^2$

Energization time: 0.3 seconds

Comparative Example 1

A surface-treated steel sheet and an organic-resin-coated steel sheet were prepared and evaluated in the same manner as in Example 1 except that the following electrolytic treatment solution was used in the cathode electrolytic treatment to form an Al oxygen compound layer on a tin-plated steel sheet. The results are shown in Table 1.

Electrolytic treatment solution: An aqueous solution where aluminum nitrate was dissolved as an Al compound and sodium hydrogen fluoride was dissolved as a fluorine compound to make Al ion concentration to 1,500 ppm by weight, nitrate ion concentration to 10,000 ppm by weight and F ion concentration to 2,100 ppm by weight.

Comparative Example 2

A surface-treated steel sheet and an organic-resin-coated steel sheet were prepared in the same manner as in Comparative Example 1 except that the thickness of the tin-plating layer formed on the steel sheet was changed to 5.6 g/m$^2$ by the Sn amount by changing tin-plating conditions. Then, in the methods described above, evaluations for measurement of the amount of Al in the Al oxygen compound layer and forming efficiency of the Al oxygen compound layer, evaluation of resistance to sulfuration blackening (actual content), evaluation of resistance to sulfuration blackening (model liquid), and evaluation of corrosion resistivity (model liquid) were performed. The results are shown in Table 1.

Comparative Example 3

A surface-treated steel sheet and an organic-resin-coated steel sheet were prepared and evaluated in the same manner as in Comparative Example 2 except that the number of cycles was increased and the total energization time was changed to 0.2 seconds in the cathode electrolytic treatment to form an Al oxygen compound layer on a tin-plated steel sheet. The results are shown in Table 1.

Comparative Example 4

A surface-treated steel sheet and an organic-resin-coated steel sheet were prepared and evaluated in the same manner as in Comparative Example 2 except that, as a pretreatment to form an Al oxygen compound layer on a tin-plated steel sheet by the cathode electrolytic treatment, the cathode electrolytic treatment was performed in an alkali aqueous solution under the following conditions using the tin-plated steel sheet as a cathode, and that the number of cycles was increased and the total energization time was changed to 0.3 seconds in the cathode electrolytic treatment to form the Al oxygen compound layer on the tin-plated steel sheet. The results are shown in Table 1.

Alkali aqueous solution: sodium carbonate aqueous solution (10 g/lit.)

Temperature: 40° C.

Electric current density: 3 A/dm$^2$

Energization time: 0.3 seconds

Comparative Example 5

A surface-treated steel sheet and an organic-resin-coated steel sheet were prepared and evaluated in the same manner as in Comparative Example 1 except that the following electrolytic treatment solution was used, the number of cycles was increased and the total energization time was changed to 7.2 seconds in the cathode electrolytic treatment to form an Al oxygen compound layer on a tin-plated steel sheet. Then, in the methods described above, evaluations for measurement of the amount of Al in the Al oxygen compound layer and forming efficiency of the Al oxygen compound layer, evaluation of resistance to sulfuration blackening (model liquid) and evaluation of corrosion resistivity (model liquid) were performed. The results are shown in Table 1.

Electrolytic treatment solution: An aqueous solution where aluminum nitrate was dissolved as an Al compound and sodium hydrogen fluoride was dissolved as a fluorine compound, to make Al ion concentration to 1,500 ppm by weight, nitrate ion concentration to 10,000 ppm by weight and F ion concentration to 4,200 ppm by weight Reference Example 1

To a chromate-treated (311 treatment) tin-plated steel sheet (where the Sn amount is 5.6 mg/m$^2$ and the Cr amount is 7 mg/m$^2$) available on the market, each of the above evaluations was performed. The results are shown in Table 1 as Reference Example 1.

TABLE 1

| | Tin-plating Sn amount [g/m$^2$] | Pre-treatment | Electrolytic treatment solution: Al ion concentration [wt · ppm] | F ion concentration [wt · ppm] | Nitrate ion concentration [wt · ppm] | pH | Temp. [° C.] | Electric conductivity [mS/cm] | Cathode electrolytic treatment conditions: Electric current density [A/dm$^2$] | Total energization time [sec] | Electricity amount [C/dm$^2$] |
|---|---|---|---|---|---|---|---|---|---|---|---|
| Example 1 | 2.8 | Not performed. | 1500 | 0 | 15000 | 3.0 | 40 | 23 | 4 | 0.1 | 0.4 |
| Example 2 | 5.6 | Not performed. | | | | | | | | 0.1 | 0.4 |
| Example 3 | | Not performed. | | | | | | | | 0.3 | 1.2 |

TABLE 1-continued

| | | | | | | | |
|---|---|---|---|---|---|---|---|
| Example 4 | | Not performed. | | | | 0.7 | 2.8 |
| Example 5 | | Performed. | | | | 0.3 | 1.2 |
| Comparative Example 1 | 2.8 | Not performed. | 2100 | 10000 | 17 | 0.1 | 0.4 |
| Comparative Example 2 | 5.6 | Not performed. | | | | 0.1 | 0.4 |
| Comparative Example 3 | | Not performed. | | | | 0.2 | 0.8 |
| Comparative Example 4 | | Performed. | | | | 0.3 | 1.2 |
| Comparative Example 5 | 2.8 | Not performed. | 4200 | 10000 | 22 | 7.2 | 28.8 |
| Reference Example 1 | 5.6 | Not performed. | | | | | |

| | Al oxygen compound layer Al amount [mg/m$^2$] | Forming efficiency of the Al oxygen compound layer: Al amount/electricity amount [mg/C] | Forming efficiency of the Al oxygen compound layer: Evaluation | Organic-resin-coated surface-treated steel sheet: Evaluation of resistance to sulfuration blackening: Actual content* | Evaluation of resistance to sulfuration blackening: Model liquid** | Evaluation of corrosion resistivity Model liquid*** |
|---|---|---|---|---|---|---|
| Example 1 | 5.0 | 0.125 | A | | 3 | 2 |
| Example 2 | 4.5 | 0.113 | A | 3 | 3 | 2 |
| Example 3 | 7.3 | 0.060 | A | 3 | 3 | 2 |
| Example 4 | 11.8 | 0.042 | A | 3 | 3 | 2 |
| Example 5 | 8.5 | 0.071 | A | 3 | 3 | 2 |
| Comparative Example 1 | 7.5 | 0.188 | A | | 2 | 2 |
| Comparative Example 2 | 6.3 | 0.157 | A | 2 | 2 | 2 |
| Comparative Example 3 | 10.1 | 0.126 | A | 2 | 2 | 2 |
| Comparative Example 4 | 5.8 | 0.048 | A | 2 | 2 | 2 |
| Comparative Example 5 | 8.6 | 0.003 | B | | 1 | 1 |
| Reference Example 1 | | | | 2 | 2 | 2 |

*3 is a pass.
**3 is a pass.
***2 or over is a pass.

As shown in Table 1, in Example 1 to Example 5 where an Al oxygen compound layer was formed onto a tin-plated steel sheet by the cathode electrolytic treatment using an electrolytic treatment solution not containing F ions and where the amount of nitrate ions contained is 11,500 to 25,000 ppm by weight, all of the obtained organic-resin-coated steel sheets exhibited excellent results in the evaluation of forming efficiency of the Al oxygen compound layer, evaluation of resistance to sulfuration blackening (model liquid), and evaluation of corrosion resistivity (model liquid). Accordingly, it was confirmed that the forming efficiency of the Al oxygen compound layer was excellent and that sulfuration blackening was suppressed even when stored at high temperatures. Particularly, in Example 2 to Example 5, the results of the evaluation of resistance to sulfuration blackening (actual content) were excellent for the obtained organic-resin-coated steel sheet that it was confirmed that sulfuration blackening can be suppressed even when a can container is produced and filled with the actual content. These results were better than that of Reference Example 1 where a chromate-treated (311 treatment) tin-plated steel sheet available on the market and currently in use was used. Further, since the evaluation of corrosion resistivity exhibited a result equivalent to Reference Example 1 where a chromate-treated (311 treatment) tin-plated steel sheet available on the market and currently in use was used, it was shown that the method used in the examples is applicable as an alternative to the chromate treatment. Furthermore, although evaluation of resistance to sulfuration blackening (actual content) was not performed in Example 1, since the result in the evaluation of resistance to sulfuration blackening (model liquid) was excellent, it can be predicted that the result for the evaluation of resistance to sulfuration blackening (actual content) will be excellent as in Example 2 to Example 5.

On the other hand, in Comparative Example 1 to Comparative Example 5 where F ions were included in an electrolytic treatment solution, the results of the evaluation of resistance to sulfuration blackening (model liquid) were all bad for the obtained organic-resin-coated steel sheet, and it was confirmed that sulfuration blackening occurs when the steel sheet is stored at high temperature. Particularly, in Comparative Example 2 to Comparative Example 4, the results of the evaluation of resistance to sulfuration blackening (actual content) were bad for the obtained organic-resin-coated steel sheet, and it was confirmed that sulfuration blackening occurs when a can container is produced and filled with the actual content. As for Comparative Example 1 and Comparative Example 5, although evaluation of resistance to sulfuration blackening (actual content) was not performed, because the results in the evaluation of resistance to sulfuration blackening (model liquid) were bad, it can be predicted that as in Comparative Example 2 to Comparative Example 4, the results of the evaluation of resistance to sulfuration blackening (actual content) will be bad. Further, among Comparative Example 1 to Comparative Example 5, in Comparative Example 5 where the amount of F ions contained in the electrolytic treatment solution was increased, the result of the evaluation of corrosion resistivity (model liquid) was also bad and it was confirmed that corrosion resistivity was also decreased.

Example 6

A surface-treated steel sheet and an organic-resin-coated steel sheet were prepared and evaluated in the same manner as in Example 1 except that the following electrolytic treatment solution was used and the number of cycles was increased to change the total energization time to 0.7 seconds in the cathode electrolytic treatment to form an Al oxygen compound layer on a tin-plated steel sheet. Then, in the methods described above, evaluations of measurement of the amount of Al in the Al oxygen compound layer and forming efficiency of the Al oxygen compound layer, evaluation of resistance to sulfuration blackening (model liquid) and evaluation of corrosion resistivity (model liquid) were performed. The results are shown in Table 2.

Electrolytic treatment solution: An aqueous solution where aluminum nitrate was dissolved as an Al compound to make Al ion concentration to 1,500 ppm by weight, nitrate ion concentration to 12,500 ppm by weight and F ion concentration to 0 ppm by weight.

Example 7

A surface-treated steel sheet and an organic-resin-coated steel sheet were prepared and evaluated in the same manner as in Example 6 except that the number of cycles was increased and the total energization time was changed to 1.5 seconds in the cathode electrolytic treatment to form an Al oxygen compound layer on a tin-plated steel sheet. The results are shown in Table 2.

Example 8 to Example 11

A surface-treated steel sheet and an organic-resin-coated steel sheet were prepared and evaluated in the same manner as in Comparative Example 6 except that the concentration of nitrate ions in the electrolytic treatment solution and the total energization time were changed as shown in Table 2 in the cathode electrolytic treatment to form an Al oxygen compound layer on a tin-plated steel sheet. The results are shown in Table 2.

Comparative Example 6 to Comparative Example 10

A surface-treated steel sheet and an organic-resin-coated steel sheet were prepared and evaluated in the same manner as in Example 6 except that the concentration of nitrate ions in the electrolytic treatment solution and the total energization time were changed as shown in Table 2 in the cathode electrolytic treatment to form an Al oxygen compound layer on a tin-plated steel sheet. The results are shown in Table 2.

Comparative Example 11

A surface-treated steel sheet and an organic-resin-coated steel sheet were prepared and evaluated in the same manner as in Example 6 except that the following electrolytic treatment solution was used in the cathode electrolytic treatment to form an Al oxygen compound layer on a tin-plated steel sheet. The results are shown in Table 1.

Electrolytic treatment solution: An aqueous solution where aluminum nitrate was dissolved as an Al compound and sodium hydrogen fluoride was dissolved as a fluorine compound to make Al ion concentration to 1,500 ppm by weight, nitrate ion concentration to 10,000 ppm by weight and F ion concentration to 2,000 ppm by weight.

TABLE 2

| | Tin-plating Sn amount [g/m$^2$] | Pre-treatment | Electrolytic treatment solution: Al ion concentration [wt · ppm] | F ion concentration [wt · ppm] | Nitrate ion concentration [wt · ppm] | pH | Temp. [° C.] | Electric conductivity [mS/cm] | Cathode electrolytic treatment conditions: Electric current density [A/dm$^2$] | Total energization time [sec] | Electricity amount [C/dm$^2$] |
|---|---|---|---|---|---|---|---|---|---|---|---|
| Example 6 | 2.8 | Not performed. | 1,500 | 0 | 12,500 | 3.0 | 40 | 16 | 4 | 0.7 | 2.8 |
| Example 7 | | | | | | | | | | 1.5 | 6.0 |
| Example 8 | | | | | 15,000 | | | 21 | | 0.2 | 0.8 |
| Example 9 | | | | | | | | | | 0.7 | 2.8 |
| Example 10 | | | | | 20,000 | | | 29 | | 0.2 | 0.8 |
| Example 11 | | | | | | | | | | 0.3 | 1.2 |
| Comparative Example 6 | | | | | 10,000 | | | 12 | | 1.4 | 5.6 |
| Comparative Example 7 | | | | | | | | | | 2.5 | 10.0 |
| Comparative Example 8 | | | | | 11,000 | | | 14 | | 1.4 | 5.6 |
| Comparative Example 9 | | | | | | | | | | 2.5 | 10.0 |
| Comparative Example 10 | | | | | 25,500 | | | 35 | | 1.4 | 5.6 |
| Comparative Example 11 | | | | 2,000 | 10,000 | | | 22 | | 0.2 | 0.8 |

TABLE 2-continued

| | Al oxygen compound layer Al amount [mg/m$^2$] | Forming efficiency of the Al oxygen compound layer: Al amount/ electricity amount [mg/C] | Forming efficiency of the Al oxygen compound layer: Evaluation | Organic-resin-coated surface-treated- steel sheet: Evaluation of resistance to sulfuration blackening Model liquid** | Organic-resin-coated surface-treated- steel sheet: Evaluation of corrosion resistivity Model liquid*** |
|---|---|---|---|---|---|
| Example 6 | 5.0 | 0.018 | A | 3 | 2 |
| Example 7 | 7.9 | 0.013 | A | 3 | 2 |
| Example 8 | 7.0 | 0.088 | A | 3 | 2 |
| Example 9 | 10.4 | 0.037 | A | 3 | 2 |
| Example 10 | 6.6 | 0.083 | A | 3 | 2 |
| Example 11 | 11.1 | 0.093 | A | 3 | 2 |
| Comparative Example 6 | 5.0 | 0.009 | B | 3 | 2 |
| Comparative Example 7 | 8.0 | 0.008 | B | 3 | 2 |
| Comparative Example 8 | 5.5 | 0.010 | B | 3 | 2 |
| Comparative Example 9 | 8.5 | 0.009 | B | 3 | 2 |
| Comparative Example 10 | 2.9 | 0.005 | B | 2 | 2 |
| Comparative Example 11 | 7.0 | 0.088 | A | 2 | 2 |

**3 is a pass.
***2 or over is a pass.

As shown in Table 2, in Example 6 to Example 11 where an Al oxygen compound layer was formed onto a tin-plated steel sheet by cathode electrolytic treatment using an electrolytic treatment solution not containing F ions and where the amount of nitrate ions contained is 11,500 to 25,000 ppm by weight, all of the obtained organic-resin-coated steel sheets exhibited excellent results in the evaluation of forming efficiency of the Al oxygen compound layer, evaluation of resistance to sulfuration blackening (model liquid), and evaluation of corrosion resistivity (model liquid). Accordingly, it was confirmed that the forming efficiency of the Al oxygen compound layer was excellent and that sulfuration blackening was suppressed even when stored at high temperatures. Particularly in Example 8 to Example 11, because electric conductivity of the electrolytic treatment solution was high, electrolysis of water was successfully generated near the surface of the tin-plated steel sheet when electric current was fed. Consequently, it can be considered that the pH near the surface of the tin-plated steel sheet was raised and the Al oxygen compound was efficiently deposited. Further, it was confirmed that even when the total energization time was as short as about 0.2 seconds, much Al oxygen compound layer where the Al amount is 5 mg/m$^2$ or more was formed.

On the other hand, in Comparative Example 6 to Comparative Example 9 where F ions are not contained but the amount of nitrate ions contained was less than 11,500 in the electrolytic treatment solution, the results of the evaluation of resistance to sulfuration blackening (model liquid) were all excellent for the obtained organic-resin-coated steel sheet and the results exhibited that sulfuration blackening can be suppressed even when stored at high temperature. However, as electric conductivity of the electrolytic treatment solution was low, the results of the forming efficiency of the Al oxygen compound layer were bad and it was confirmed that forming efficiency of the Al oxygen compound layer was insufficient.

In Comparative Example 10 where F ions are not contained but the amount of nitrate ions contained was more than 25,000 ppm by weight in the electrolytic treatment solution, because the electric conductivity of the electrolytic treatment solution was too high, the tin-plating layer on the surface of the tin-plated steel sheet was etched when the cathode electrolytic treatment was conducted and the forming efficiency of the Al oxygen compound layer became low. By having greater etching in the tin-plating layer, more dissolved tin was included in the Al oxygen compound layer, thus the result of the evaluation of resistance to sulfuration blackening (model liquid) was unsatisfactory. As a result, it was confirmed that sulfuration blackening will be generated when stored at high temperature.

Additionally, also in Comparative Example 11 where F ions were contained in the electrolytic treatment solution, the result of the evaluation of resistance to sulfuration blackening (model liquid) was similarly unsatisfactory. Accordingly, it was found that sulfuration blackening will be generated when stored at high temperature.

What is claimed is:

1. A method for producing a surface-treated steel sheet comprising:

forming an Al oxygen compound layer which is a layer mainly composed of an oxygen compound containing Al onto a tin-plated steel sheet by conducting cathode electrolytic treatment using an electrolytic treatment solution containing an Al ion and nitrate ion to the tin-plated steel sheet, wherein the electrolytic treatment solution does not contain F ion and where an amount of the nitrate ion contained is 15,000 to 25,000 ppm by weight, the cathode electrolytic treatment is conducted under a condition of an amount of electricity of 0.4 C/dm$^2$ to 2.8C/dm, the Al oxygen compound layer has an Al amount of 2 to 11.8 mg/m$^2$, and a particle diameter of particles of an Al oxygen compound which form the Al oxygen compound layer is 50 nm or less.

2. The method for producing the surface-treated steel sheet according to claim 1, wherein a value (mg/C) obtained by dividing the amount of Al contained in the Al oxygen compound layer by an amount of electricity in the cathode electrolytic treatment is 0.011 or more.

3. The method for producing the surface-treated steel sheet according to claim 1, wherein electric conductivity of the electrolytic treatment solution is 16 to 35 mS/cm.

4. The method for producing the surface-treated steel sheet according to claim 1, wherein a pH of the electrolytic treatment solution is 2.0 to 4.0.

5. The surface-treated steel sheet obtained by the method according to claim 1.

6. An organic resin coated metal container obtained by using the surface-treated steel sheet according to claim 5.

7. The method for producing the surface-treated steel sheet according to claim 1, wherein an amount of an Al ion contained in the electrolytic treatment solution is 0.5 to 10 g/lit. in a mass concentration of Al atoms.

* * * * *